US006941923B2

(12) United States Patent
Saito

(10) Patent No.: US 6,941,923 B2
(45) Date of Patent: Sep. 13, 2005

(54) FASTENING JIG FOR A BAFFLE PLATE FOR OIL PAN USE AND FASTENING METHOD THEREOF

(75) Inventor: Haruhiko Saito, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/959,964

(22) Filed: Oct. 8, 2004

(65) Prior Publication Data

US 2005/0081814 A1 Apr. 21, 2005

(30) Foreign Application Priority Data

Oct. 21, 2003 (JP) ..... 2003-360564

(51) Int. Cl.[7] ..... F02M 11/00; F02F 7/00

(52) U.S. Cl. ..... 123/196 R; 123/195 C; 123/198 E; 184/6.5; 184/106

(58) Field of Search ..... 123/195 C, 196 R, 123/198 E; 184/6.5, 106

(56) References Cited

U.S. PATENT DOCUMENTS

| | | | | | |
|---|---|---|---|---|---|
| 4,856,486 | A | * | 8/1989 | Mori et al. | 123/572 |
| 4,909,203 | A | * | 3/1990 | Fukuo | 123/196 R |
| 5,133,313 | A | * | 7/1992 | Inoue et al. | 123/195 C |
| 5,456,227 | A | * | 10/1995 | Shimmell et al. | 123/195 H |
| 5,960,763 | A | | 10/1999 | Yamamura | |
| 2003/0145821 | A1 | * | 8/2003 | Hashimoto et al. | 123/192.2 |
| 2004/0040532 | A1 | * | 3/2004 | Maeda et al. | 123/196 R |

FOREIGN PATENT DOCUMENTS

| | | | |
|---|---|---|---|
| JP | 04-321710 | A | 11/1992 |
| JP | 10-61488 | A | 3/1998 |

* cited by examiner

*Primary Examiner*—Weilun Lo
(74) *Attorney, Agent, or Firm*—Oliff & Berridge, PLC

(57) ABSTRACT

A baffle plate is arranged between a crankshaft axially supported in a freely rotating manner by a cylinder block and a bearing cap and an oil pan storing lubricating oil supplied to each part of a vehicle engine. The baffle plate is fastened to the bearing cap using parent bolts for fastening the bearing cap and the cylinder block through screwing from the bottom surface of the bearing cap.

3 Claims, 6 Drawing Sheets

FASTENING JIG FOR A BAFFLE PLATE FOR OIL PAN USE AND FASTENING METHOD THEREOF

CROSS-REFERENCE TO RELATED APPLICATIONS

The priority Japanese Patent Application Number 2003-360564 upon which this patent application is based is hereby incorporated by reference.

1. Field of Invention

The present invention relates to an oil pan baffle plate fastening jig and fastening method for arranging a baffle plate between a crankshaft and an oil pan for storing lubricating oil supplied to each part of a vehicle engine.

BACKGROUND OF THE INVENTION

2. Prior Art

Lubricating oil supplied to each of the parts within a vehicle engine is stored in an oil pan provided at a lower part of an engine. The stored lubricating oil is sucked up by an oil pump, purified through filtering by an oil filter, and the supplied to the engine again. A plate referred to as a baffle plate is provided between the oil pan and the crankshaft. The baffle plate is provided to prevent the stored lubricating oil from building up so as to tend towards one side. Normally, oil drip holes for discharging lubricating oil dropping from above to the oil pan are formed at this baffle plate.

Here, some of the lubricating oil that is provided again is utilized by hydraulic equipment provided within the engine such as, for example, a rush adjuster. When bubbles (air) are mixed within lubricating oil utilized by hydraulic equipment, there may be cases where abnormalities occur in the behavior of the hydraulic equipment. Namely, when bubbles become mixed with lubricating oil stored in the oil pan, abnormal behavior may be exhibited by the hydraulic equipment. Because of this, it is desirable for there to be as few bubbles (as little air) as possible (preferably none) mixed in with the lubricating oil stored in the oil pan.

One factor contributing to bubbles being generated in stored lubricating oil is when a large amount of lubricating oils remains on the baffle plate. Normally, lubricating oil on the baffle plate can be discharged to the oil pan from the oil drip holes. However, when the distance between the oil level of the lubricating oil stored in the oil pan and the baffle plate becomes too small, discharge of lubricating oil on the baffle plate is no longer performed in a normal manner. As a result, a large quantity of lubricating oil remains on the baffle plate. It is easy for bubbles to occur in this residual lubricating oil. The reason for this is that a counterweight is rotatably driven on the baffle plate and there is therefore interference between this counterweight and the residual lubricating oil. A further reason is that ruffles may occur in the residual lubricating oil due to rotational airstreams generated in accompaniment with rotation of a counterweight.

In order to prevent a large amount of lubricating oil from remaining, the oil pan is provided lower down, so as to create distance between the baffle plate and the oil level of the stored lubricating oil. However, this causes the engine to be high overall and is not preferable.

In Japanese patent specification No. 3072389, a baffle plate structure where a baffle plate is fastened to the bottom surface of a bearing cap is disclosed. By fastening a baffle plate to the bottom surface of a bearing cap, it is possible to create distance between the baffle plate and the oil level of the stored lubricating oil without lowering the position of the oil pan. This enables the occurrence of bubbles within the stored lubricating oil to be reduced.

However, with the above structure, it is necessary to provide a bearing surface use in fastening the baffle plate at the bottom surface of the bearing cap, which makes the overall width of the vehicle engine large. In recent years, there has been a desire for vehicle engines to be lightweight and compact. It is therefore not desirable to provide a new bearing surface etc. at the bottom surface of the bearing cap.

SUMMARY OF THE INVENTION

The present invention is advantageous in providing a fastening jig for a baffle plate and method thereof capable of ensuring that a vehicle engine is small and that the number of bubbles in lubricating oil stored in an oil pan is reduced.

With the fastening jig for a baffle plate for use with an oil pan of the present invention, a baffle plate is arranged between an oil pan storing lubricating oil supplied to each part of a vehicle engine and a crankshaft axially supported in a freely rotating manner by a cylinder block and a bearing cap. The fastening jig for a baffle plate for use with this oil pan has parent bolt and child bolt The parent bolt are formed with a female threaded section for fastening the bearing cap and the cylinder block through screwing from the bottom surface of the bearing cap. The child bolt are capable of being screwed into the female threaded section of the parent bolt, and the baffle plate can be fastened to the head section of the parent bolt through screwing into the female threaded section. In an appropriate mode, the lengths of screwing section of the child bolt are shorter than the thickness of the head section of the parent bolt.

In a further aspect of the present invention, in a fastening method for a baffle plate for use with an oil pan, the baffle plate is arranged between an oil pan storing lubricating oil supplied to each part of a vehicle engine and a crankshaft axially supported in a freely rotating manner by a cylinder block and a bearing cap. The baffle plate is fastened to the bearing cap using parent bolts for fastening the bearing cap and the cylinder block through screwing from the bottom surface of the bearing cap. In an appropriate mode, the baffle plate is fastened to head sections of the parent bolts by screwing female threaded sections provided at head sections of the parent bolts and child bolts capable of being screwed into the female threaded sections together.

According to the present invention, it is possible to ensure that a vehicle engine is small and that the number of bubbles in lubricating oil stored in an oil pan is reduced.

DETAILED DESCRIPTION OF THE INVENTION

The following is a description with reference to the drawings of an embodiment of the present invention.

Figure 1:
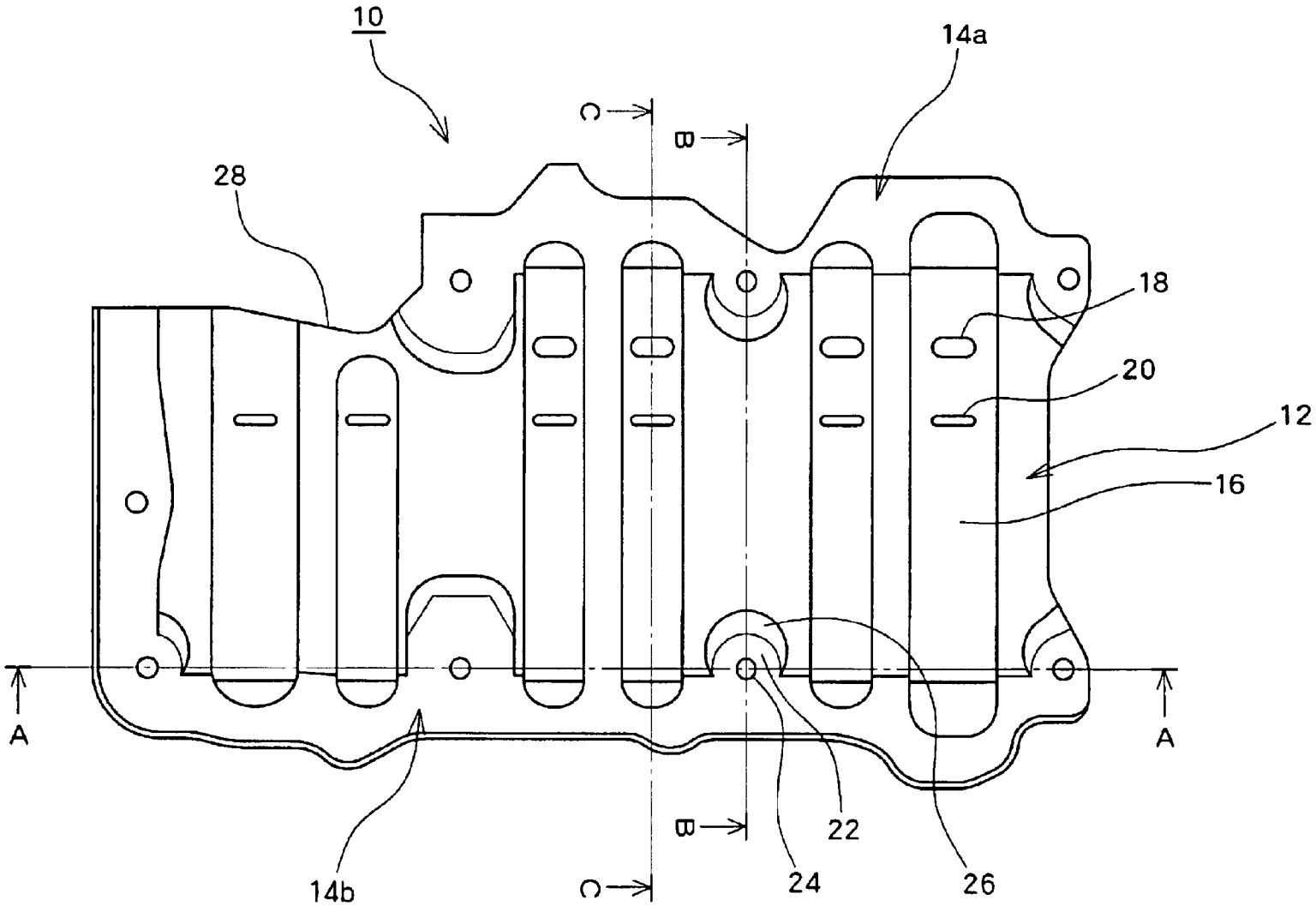
FIG. 1 is a plan view of a baffle plate subjected to fastening.
Figure 2:
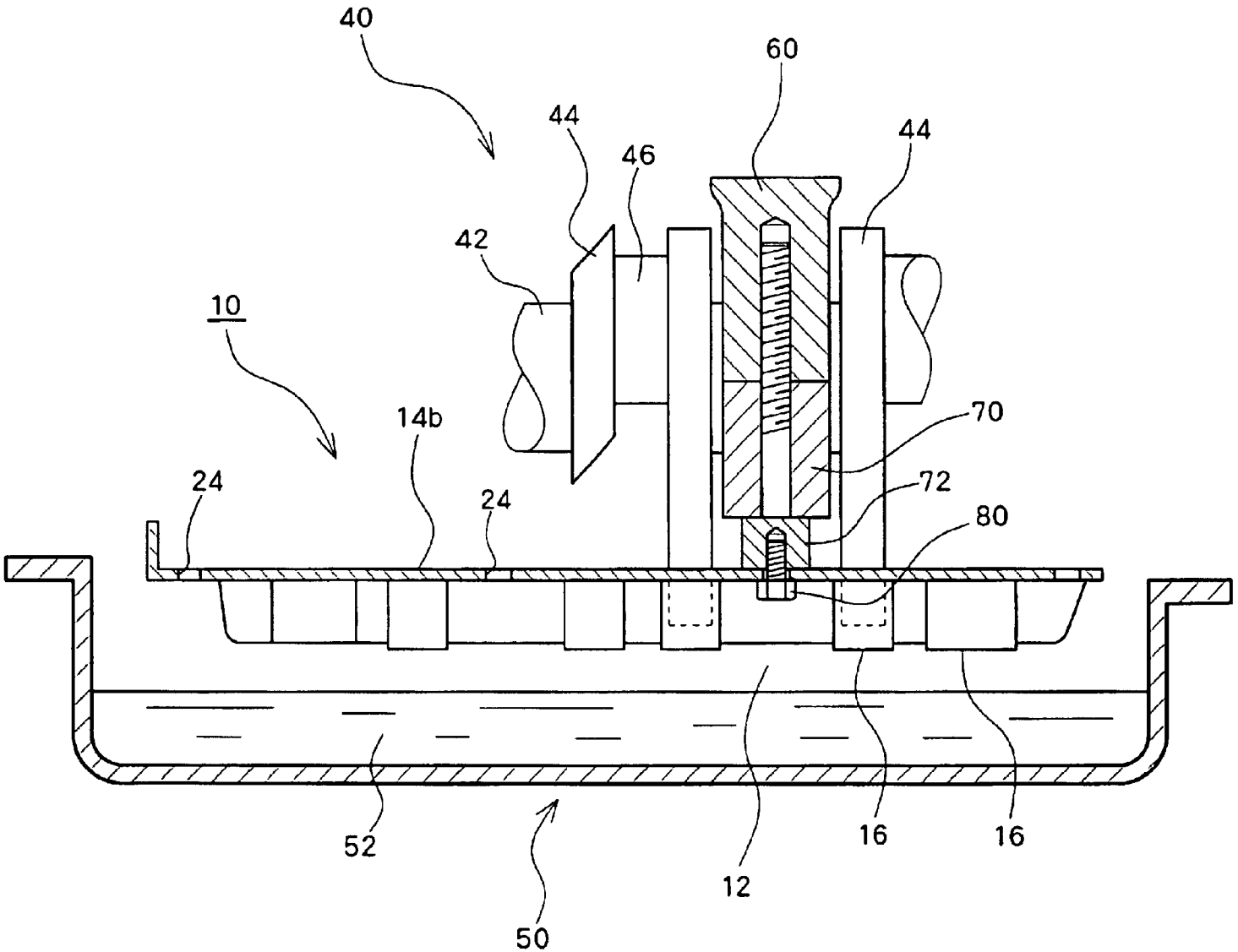
FIG. 2 is a cross-sectional view along A—A of FIG. 1 of the baffle plate at the time of fastening.

FIG. 1 is a plan view of the baffle plate 10 to be fastened and FIG. 2 is a cross-sectional view along A—A in FIG. 1 of the baffle plate 10 at the time of fastening. A cross-sectional view along B—B in FIG. 1 is shown in FIG. 3, and a cross-sectional view along C—C in FIG. 1 is shown in FIG. 4.

The baffle plate 10 is to be used in a vehicle engine and is therefore a comparatively thin metal plate made by press molding. As shown in FIG. 2, the baffle plate 10 is provided between the crankshaft 40 and the oil pan 50. The baffle plate 10 has a body section 12 and flanges 14*a* and 14*b* projecting at each side. A notched section 28 for arranging a strainer (not shown) is provided at a corner.

Figure 3:
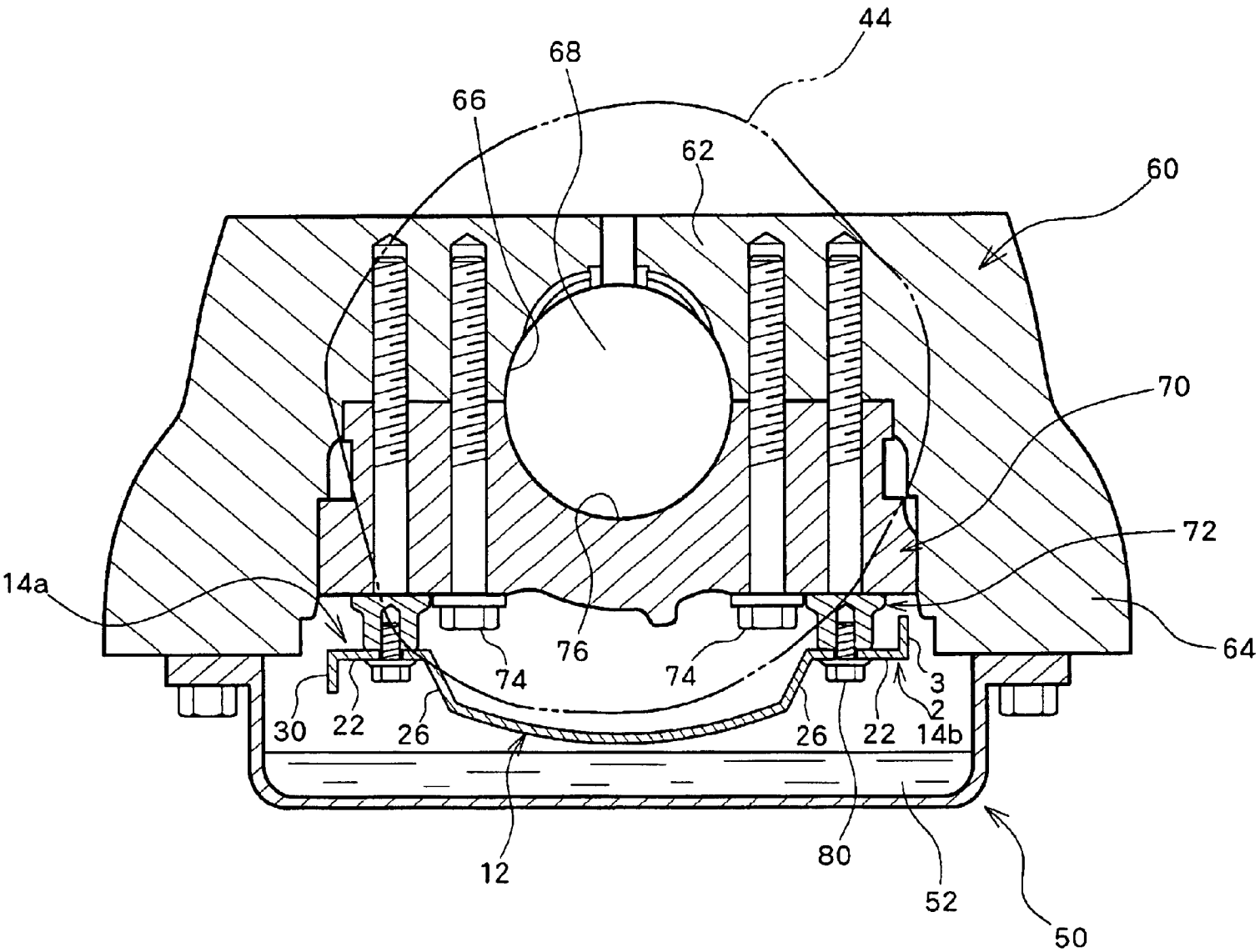
FIG. 3 is a cross-sectional view along B—B of FIG. 1 of the baffle plate at the time of fastening.
Figure 4:
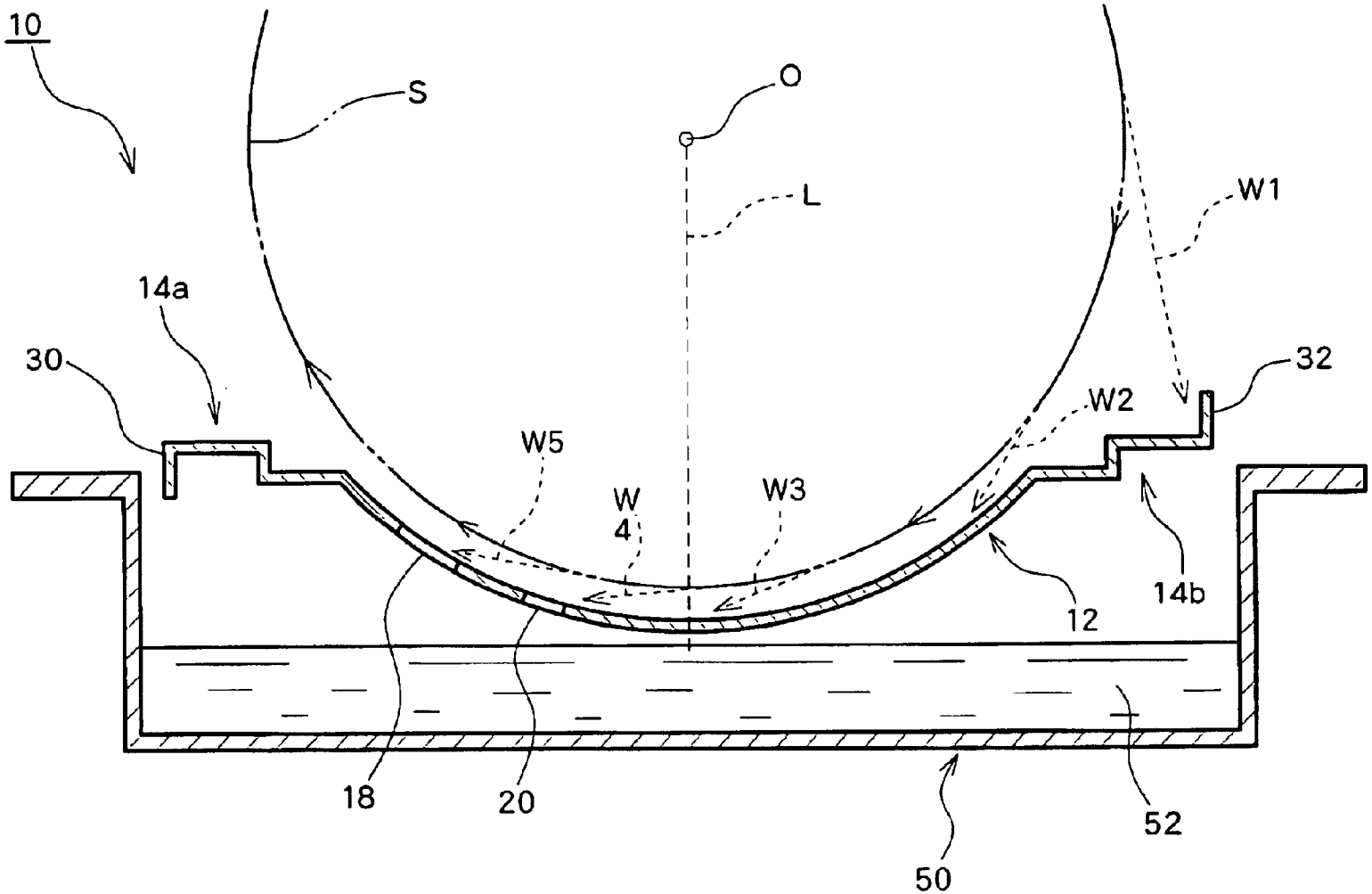
FIG. 4 is a cross-sectional view along C—C of FIG. 1 of the baffle plate at the time of fastening.

As shown in FIG. 3 and FIG. 4, the body section 12 has an arc-shaped cross-section projecting downwards. Oil drip holes 18 and 20 for discharging lubricating oil falling downwards to the oil pan 50 are formed on the upper surface of the body section 12. Flange sections 14*a* and 14*b* project from both sides of the body section 12, and are fastened to the bottom surface of a bearing cap 70 (refer to FIG. 3). Fastening holes 24 constituting fastening bolt holes are provided at the flange sections 14*a* and 14*b*.

Each of the parts is described in detail in the following.

As shown in FIG. 2, the baffle plate 10 is provided between the crankshaft 40 and the oil pan 50. As is well known, the crankshaft 40 rotates according to reciprocating movement of a piston (not shown). A journal 42 constituting a rotating shaft, a crank pin 46 connected to a connecting rod (not shown in the drawings), and a counterweight 44 giving overall balance are provided at the crankshaft 40. The journal 42 is axially supported in a freely rotating manner by the bearing cap 70 and the cylinder block 60.

On the other hand, the oil pan 50 stores lubricating oil provided to each of the parts within the engine and is therefore a deep-bottomed container. Lubricating oil 52 stored in the oil pan 50 is sucked up by an oil pump (not shown) via the strainer, and is purified through filtering at the oil filter (not shown). Lubricating oil purified through filtering is the supplied again to each part of the engine.

A plurality of recesses 16 that are more hollow than the surroundings are foamed at a portion substantially directly under the counterweight 44 of the crankshaft 40 at the main body 12 of the baffle plate 10. The recesses 16 are substantially arc-shaped along a locus of rotation of the counterweight 44 shown in FIG. 4. The oil drip holes 18 and 20 for discharging lubricating oil dropping down onto the baffle plate 10 to the oil pan 50 are provided at the recesses 16.

Lubricating oil on the baffle plate 10 then flows into the oil pan 50 from the oil drip holes 18 and 20. However, there are also cases where, when the oil level of the lubricating oil stored in the oil pan 50 and the baffle plate 10 come close to each other, lubricating oil stored in the oil pan 50 flows in reverse onto the baffle plate 10 from the oil drip holes 18 and 20. There are therefore also cases where there is interference between the lubricating oil on the baffle plate 10 and the rotating counterweight 44. Further, even if there is no interference between the baffle plate 10 and the rotating counterweight 44, ruffles occur in the oil level of the lubricating oil due to rotational airstreams W1 to W5 occurring due to rotation of the counterweight 44. As a result, bubbles are generated afresh in the lubricating oil.

It has therefore been considered to provide the oil pan 50 lower down in order to prevent this kind of counterflow of lubricating oil (flow from the oil pan 50 to the baffle plate 10). However, this causes the engine to be high overall and is not preferable.

In this embodiment, the baffle plate 10 is fastened to the bottom surface of the bearing cap 70 in order to create distance between the baffle plate 10 and the oil level of the lubricating oil without lowering the position of the oil pan 50. This is described using FIG. 3 and FIG. 5.

Figure 5:
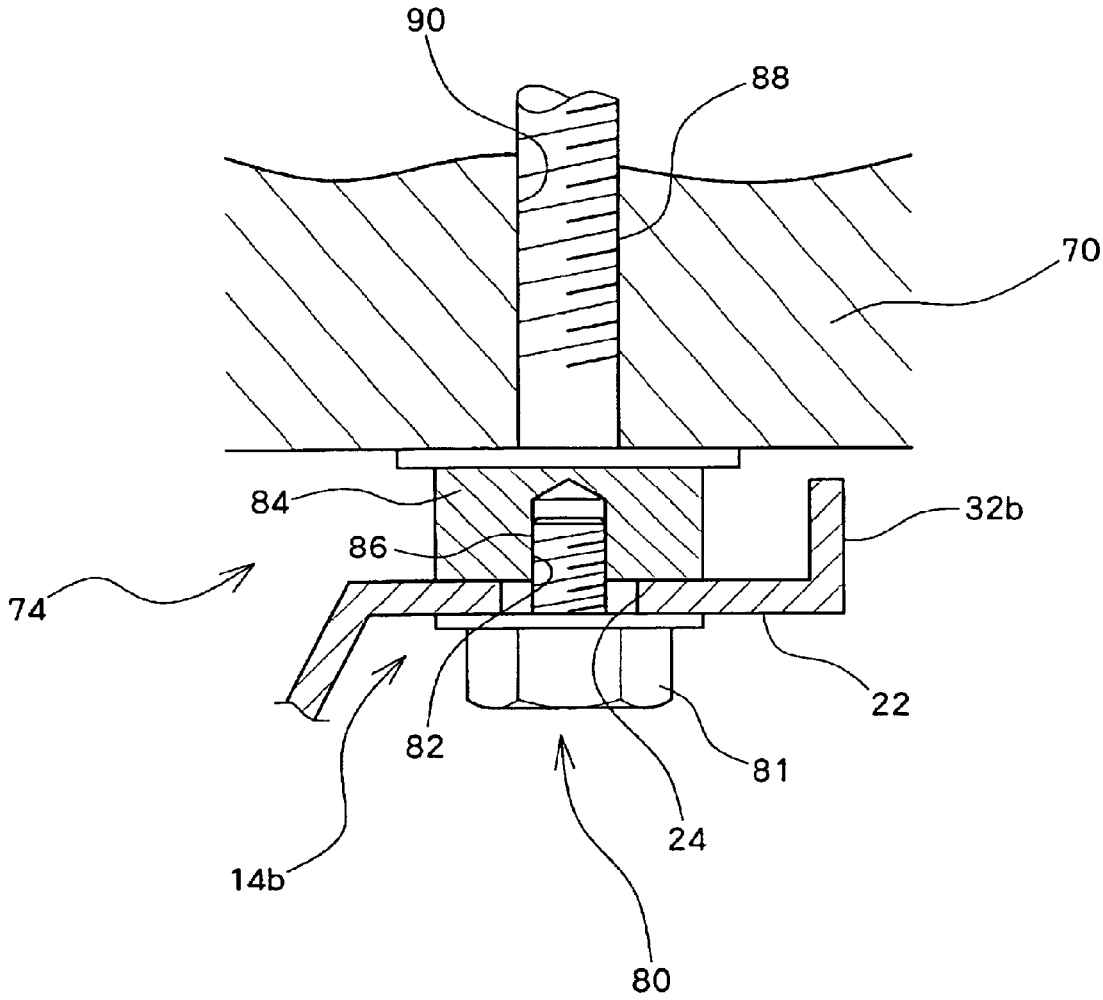
FIG. 5 is a partial enlarged view of FIG. 3.

FIG. 3 is a cross-sectional view along B—B of FIG. 1 of when the baffle plate 10 is fastened to the bearing cap 70. FIG. 5 is an enlarged partial view of FIG. 3.

The bearing cap 70 is axially supported by the crankshaft 40 in cooperation with the cylinder block 60. A semi-circular arced surface 76 for axially supporting the journal 42 of the crankshaft 40 is formed at the upper surface of the bearing cap 70. A plain bearing (not shown) is fitted to the semi-circular arced surface 76 so that the journal 42 is supported in a freely rotatable manner.

Further, the cylinder block 60 is provided with a bearing section 62 for axially supporting the crankshaft 40 in cooperation with the bearing cap 70 and a skirt section 64 extending downwards from the left and right ends. A semi-circular arc-shaped surface 66 for axially supporting the journal 42 is formed at the lower surface of the bearing section 62 and the Blaine bearing is fitted. The crankshaft 40 is the axially supported in a freely rotating manner in cooperation with the bearing cap 70.

The skirt section 64 extends downwards from the left and right ends of the bearing section 62 so as to cover the periphery of the whole of the engine. The oil pan 50 is fastened to the bottom surface of the skirt section 64 using a bolt.

The bearing cap 70 and the cylinder block 60 are fastened using four bolts 74 and 72 of two types. The first fastening bolts 74 and the second fastening bolts 72 both extend to inside the cylinder block 60 from the bottom surface of the bearing cap 70 and are fastened.

The baffle plate 10 is fastened to the bottom surface of the bearing cap 70 using the second fastening bolts 72 constituting parent bolts and child bolts 80 described later. The second fastening bolts 72 are screwed into the ends at both sides of the bearing cap 70.

The second fastening bolts 72 constituting the parent bolts are comprised of male screw sections 88 constituting bolt sections for fastening a bearing cap 70 and a cylinder block 60, and head sections 84 provided at upper ends of the second fastening bolts 72. Female threaded sections 86 are formed at the head sections 84. Further, the head sections 84 are thicker than usual bolts so that the female threaded sections 86 can be made longer. By making the female threaded sections 86 longer, it is possible to make the screwing strength with the child bolts 80 stronger. However, the female threaded sections 86 are of a length that does not exceed the thickness of the head sections 84 of the second fastening bolts 72. In other words, the female threaded sections 86 are housed within the head sections 84, but do not reach the male screw sections 88 (bolt sections for fastening the bearing cap 70 and cylinder block 60). The male screw sections 88 are important parts for fastening the bearing cap 70 and the cylinder block 60, and lowering of the strength of this part is not desirable.

The child bolts 80 have male threaded sections 82 capable of screwing into the female threaded sections 86 formed in the head sections 84 of the second fastening bolts 72. The female threaded sections 86 of the second fastening bolts 72 are of lengths capable of being housed within the head sections 84 of the second fastening bolts 72 described above. The male threaded sections 82 of the child bolts 80 are also shorter than the thickness of the head sections 84 of the second fastening bolts 72.

In the event of fastening the baffle plate 10, the child bolts 80 are inserted into the fastening holes 24 formed in the flange sections 14*a* and 14*b* of the baffle plate 10, and are screwed into the female threaded sections 86 of the head sections 84 of the second fastening bolts 72. i.e. the child bolts are then screwed into the with the baffle plate 10 in a sandwiched state. As a result, the baffle plate 10 can be fastened to the bottom surface of the bearing cap 70.

It is therefore possible for the baffle plate 10 to be fastened so as to be in close contact with the counterweight 44 by fastening the baffle plate 10 to the bottom surface of the bearing cap 70 using the second fastening bolts 72 and the child bolts 80. In other words, the baffle plate 10 and the oil level of the lubricating oil stored within the oil pan 50 can be distanced from each other without lowering the position of the oil pan 50. Counterflow of the lubricating oil can therefore be prevented and the number of bubbles within the lubricating oil can be reduced. Further, it is also possible to prevent the overall width of the engine from becoming large as a result of it not being necessary to provide a new bearing surface at the bottom surface of the bearing cap 70.

The distance between the baffle plate 10 and the counterweight 44 can be adjusted using the thicknesses of the head sections of the second fastening bolts 72 constituting the parent bolts and the shape of the baffle plate 10. In this embodiment, the head sections 84 of the second fastening bolts 72 are made thicker than usual in order to prevent the baffle plate 10 and the counterweight 44 from becoming excessively close to each other. Further, side surfaces 26 in the vicinity of fastening positions at the side surfaces of the baffle plate 10 are dramatically inclined (refer to FIG. I and FIG. 3). It is therefore possible to put distance between the baffle plate 10 and the counterweight 44 by dramatically inclining the side surfaces 26 in the vicinity of the fastening positions. Further, it is possible to ensure that fastening bearing surfaces 22 formed at the flange sections 14*a* and 14*b* of the baffle plate 10 are sufficiently large.

It is also possible to adjust the intervening distance using some kind of spacing member between the baffle plate and the bottom surface of the bearing cap. It is also possible to provide a vibration absorbing member such as rubber etc. between the baffle plate and the bottom surface of the bearing cap in order to prevent vibrations accompanying movement of the engine from being transmitted to the baffle plate.

According to the embodiment described above, it is possible to prevent the engine from becoming larger overall, and to prevent bubbles from being formed in the lubricating oil.

In this embodiment, fastening is achieved using the second fastening bolts constituting parent bolts and child bolts screwing into the head sections of the parent bolts but another embodiment is also possible if the baffle plate is fastened to the bottom surface of the bearing cap using the second fastening bolts.

Figure 6A:
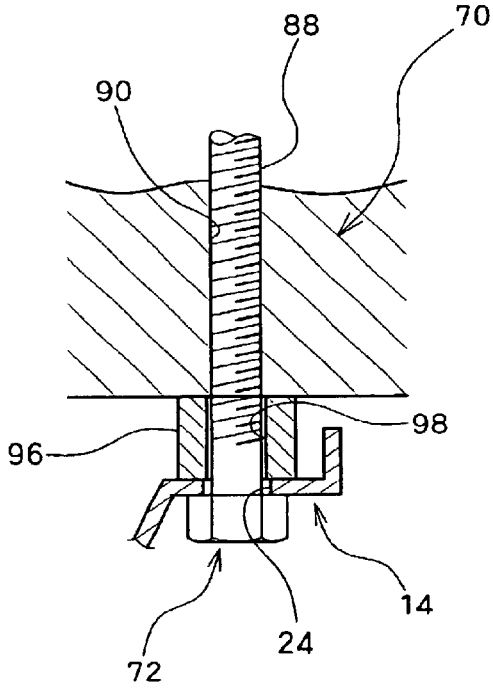
FIG. 6A is a view showing a further embodiment of the present invention.

For example, as shown in FIG. 6(A), the baffle plate 10 and the bearing caps 70 may also be fastened together using the second fastening bolts 72. Namely, the baffle plate 10 can be fastened through sandwiching while screwing the second fastening bolts 72 into the female threaded sections 90 of the bearing caps 70. During this time, it is also possible to provide a spacer 90 between the baffle plate 10 and the bottom surface of the bearing cap 70 in order to adjust the distance between the baffle plate 10 and the counterweight 44. The spacer 90 may be a nut that the second fastening bolts 72 or may be a cylindrical member formed with holes the male threaded sections 88 of the second fastening bolts 72 are capable of being inserted into.

Figure 6B:
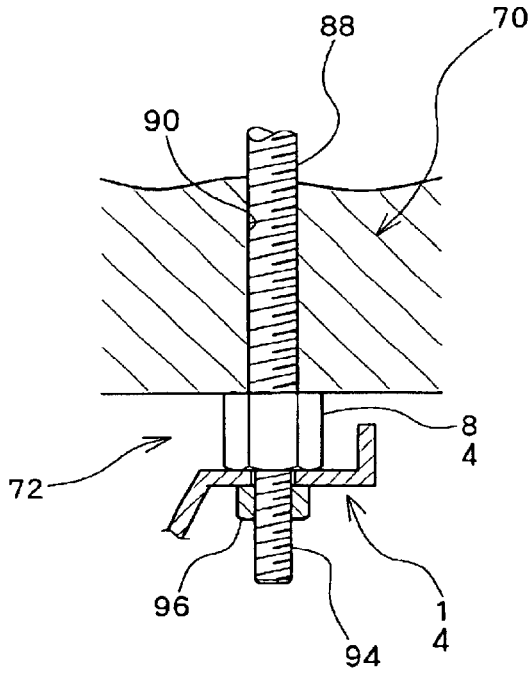
FIG. 6B is a view showing another embodiment of the present invention.

In a further embodiment, as shown in FIG. 6B, second males screws 94 for fastening the baffle plate are provided at the head sections 84 of the second fastening bolts 72. Namely, second male threaded sections 94 projecting in a direction (lower side of FIG. 6) opposite to the direction (upper side of FIG. 6) of projection of the male screw sections 88 are provided in order to fasten the bearing cap 70 and the cylinder block 60 at the head sections 84 of the second fastening bolts 72. The second male threaded sections 94 are then passed through the fastening holes 24 formed in the flange sections 14*a* and 14*b* of the baffle plate 10 and fastened using nuts 96, etc. During this time, it is also possible to adjust the height of the head sections 84 of the second fastening bolts 72 and sandwich a spacer in order to adjust the distance between the baffle plate 10 and the counterweight 44.

What is claimed is:

1. A fastening jig for a baffle plate for use with an oil pan comprising:

parent bolt for fastening a bearing cap supporting a crankshaft and a cylinder block in a freely rotatable manner through screwing from a bottom surface of the bearing cap, with a female threaded sections formed in a head section of the parent bolt; and child bolt capable of being screwed into the female threaded section, and being capable of fastening the baffle plate to the head section of the parent bolt as a result of screwing into the female threaded section;

wherein the fastening jig for a baffle plate for use with an oil pan is such that the baffle plate is provided between the crankshaft and the oil pan for storing lubricating oil supplied to each part within a vehicle engine.

2. The oil pan baffle plate fastening jig as disclosed in claim 1, wherein the lengths of a screwing section of the child bolt are shorter than the thickness of the head section of the parent bolt.

3. A method for fastening an oil pan baffle plate with a baffle plate arranged between an oil pan storing lubricating oil supplied to each part of a vehicle engine and a crankshaft axially supported in a freely rotating manner by a cylinder block and a bearing cap, comprising a step of:

fastening the baffle plate to the bearing cap using parent bolts for fastening the bearing cap and the cylinder block from a bottom surface of the bearing cap through screwing, wherein the baffle plate is fastened to head sections of the parent bolts by providing female threaded sections at head sections of the parent bolts and screwing child bolts into the female threaded section.

* * * * *